US010704337B2

(12) United States Patent
Gupta et al.

(10) Patent No.: US 10,704,337 B2
(45) Date of Patent: Jul. 7, 2020

(54) SIDE-SADDLE CANTILEVER MAST

(71) Applicant: Nabors Drilling Technologies USA, Inc., Houston, TX (US)

(72) Inventors: Ashish Gupta, Houston, TX (US); Ryan Hause, Houston, TX (US); Padira Reddy, Richmond, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 98 days.

(21) Appl. No.: 15/806,088

(22) Filed: Nov. 7, 2017

(65) Prior Publication Data

US 2018/0128056 A1 May 10, 2018

Related U.S. Application Data

(60) Provisional application No. 62/418,656, filed on Nov. 7, 2016.

(51) Int. Cl.

| | |
|---|---|
| ***E04H 12/34*** | (2006.01) |
| ***E21B 15/00*** | (2006.01) |
| *E21B 19/08* | (2006.01) |

(52) U.S. Cl.

CPC ..... *E21B 15/00* (2013.01); *E04H 12/345* (2013.01); *E04H 12/34* (2013.01); *E21B 15/006* (2013.01); *E21B 19/08* (2013.01)

(58) Field of Classification Search

CPC ..... E21B 19/08; E21B 15/00; E21B 15/006; E21B 15/003; B66F 7/065; B66F 7/06008;

(Continued)

(56) References Cited

U.S. PATENT DOCUMENTS 1,733,484 A 10/1929 Davis
2,332,479 A 10/1943 Woolslayer et al.
(Continued)

FOREIGN PATENT DOCUMENTS

CA 2755483 A1 11/2010
CA 2753417 A1 2/2011
(Continued)

OTHER PUBLICATIONS

International Search Report and Written Opinion issued in PCT/US17/60429, dated Jan. 17, 2018, 10 pages.
(Continued)

*Primary Examiner* — Phi D A
(74) *Attorney, Agent, or Firm* — Adolph Locklar

(57) ABSTRACT

A side saddle slingshot drilling rig includes a right substructure and a left substructure, the substructures positioned generally parallel and spaced apart from each other. The right substructure includes a right lower box and a first strut, the first strut pivotably coupled to the drill rig floor and pivotably coupled to the right lower box. The left substructure includes a left lower box and a second strut, the second strut pivotably coupled to the drill rig floor and pivotably coupled to the left lower box. The side saddle slingshot drilling rig also includes a drill rig floor, the drill rig floor including a V-door. The side of the drill rig floor has the V-door defining the V-door side of the drill rig floor, the V-door side of the drill rig floor parallel to the right substructure. The side saddle slingshot drilling rig further includes a mast, the mast including an open side defining a mast V-door side. The open side is oriented to face perpendicular to the right substructure. The mast is pivotably coupled to the drill rig floor by one or more mast pivot points and one or more lower mast attachment points, the mast being pivotable in a direction parallel to the V-door side of (Continued)

the drill rig floor or the mast being pivotable in a direction perpendicular to V-door side of the drill rig floor. The mast includes two or more subunits, wherein the two or more subunits are pinned together.

21 Claims, 12 Drawing Sheets

(58) Field of Classification Search
CPC ..... B66F 7/12; E04H 12/345; E04H 12/34; E04H 12/344
See application file for complete search history.

(56) References Cited

U.S. PATENT DOCUMENTS 2,345,253 A 3/1944 Funk
2,347,115 A 4/1944 Lewis
2,594,847 A 4/1952 Bates et al.
3,028,881 A 4/1962 Koomey et al.
3,228,151 A 1/1966 Woolslayer et al.
3,255,836 A 6/1966 Hoppmann et al.
3,433,268 A 3/1969 Greer
3,483,933 A 12/1969 Dyer et al.
3,576,225 A 4/1971 Chambers
3,676,984 A 7/1972 Clark
3,716,149 A 2/1973 Scaggs
3,739,853 A 6/1973 Wales
3,754,361 A 8/1973 Branham et al.
3,802,137 A 4/1974 Armstrong
3,851,770 A 12/1974 Jenkins et al.
3,922,825 A 12/1975 Eddy et al.
3,937,334 A 2/1976 Bleyl et al.
3,942,593 A 3/1976 Reeve, Jr. et al.
3,991,887 A 11/1976 Trout
4,021,978 A 5/1977 Busse et al.
4,029,165 A 6/1977 Miller et al.
RE29,541 E 2/1978 Russell
4,117,941 A 10/1978 McCleskey et al.
4,221,088 A 9/1980 Patterson
4,235,566 A 11/1980 Beeman et al.
4,267,675 A 5/1981 Cochran
4,290,495 A 9/1981 Elliston
4,375,892 A 3/1983 Jenkins et al.
4,403,898 A 9/1983 Thompson
4,407,629 A 10/1983 Willis
4,421,179 A 12/1983 Boyadjieff
4,473,977 A 10/1984 Reed
4,474,254 A 10/1984 Etter et al.
4,478,015 A 10/1984 Lawrence et al.
4,478,291 A 10/1984 Futros
4,488,708 A 12/1984 Frye
4,493,382 A 1/1985 Collins et al.
4,587,778 A 5/1986 Woolslayer et al.
4,744,710 A 5/1988 Reed
4,757,592 A * 7/1988 Reed ..... E04H 12/34 166/75.11
4,759,414 A 7/1988 Willis
4,821,816 A 4/1989 Willis
4,823,870 A 4/1989 Sorokan
4,834,604 A 5/1989 Brittain et al.
4,837,992 A 6/1989 Hashimoto
4,850,439 A 7/1989 Lund
4,899,832 A 2/1990 Bierscheid, Jr.
4,979,578 A 12/1990 Landry
5,107,940 A 4/1992 Berry
5,248,005 A 9/1993 Mochizuki
5,305,833 A 4/1994 Collins
5,375,667 A 12/1994 Trevisani
5,492,436 A * 2/1996 Suksumake ..... E02B 17/00 166/366
5,921,336 A 7/1999 Reed
6,161,358 A 12/2000 Mochizuki et al.
6,343,892 B1 2/2002 Kristiansen
6,491,477 B2 12/2002 Bennett, Jr. et al.
6,581,525 B2 6/2003 Smith
6,634,436 B1 10/2003 Desai
6,779,614 B2 8/2004 Oser
6,848,515 B2 2/2005 Orr et al.
6,955,223 B2 10/2005 Orr et al.
6,962,030 B2 11/2005 Conn
6,976,540 B2 12/2005 Berry
7,228,919 B2 6/2007 Fehres et al.
7,255,180 B2 8/2007 Beato et al.
7,308,953 B2 12/2007 Barnes
7,357,616 B2 4/2008 Andrews et al.
7,401,656 B2 7/2008 Wood et al.
7,404,697 B2 7/2008 Thompson
7,600,585 B2 10/2009 Patton et al.
7,628,229 B2 12/2009 Wood et al.
7,765,749 B2 8/2010 Palidis
7,819,207 B2 10/2010 Cowan
7,832,974 B2 11/2010 Fikowski et al.
7,878,254 B2 2/2011 Abdollahi et al.
7,931,076 B2 4/2011 Ditta et al.
7,967,540 B2 6/2011 Wright et al.
7,992,646 B2 8/2011 Wright et al.
8,051,930 B1 11/2011 Barnes et al.
8,181,698 B2 5/2012 Springett et al.
8,250,816 B2 8/2012 Donnally et al.
8,297,362 B1 10/2012 Strider et al.
8,316,588 B2 11/2012 Cicognani
3,468,753 A1 6/2013 Donnally et al.
8,474,216 B1 7/2013 Goerner
8,516,751 B2 8/2013 Konduc et al.
3,549,815 A1 10/2013 Donnally et al.
8,555,564 B2 10/2013 Wasterval
8,561,685 B2 10/2013 Rodgers
8,573,334 B2 11/2013 Smith et al.
8,661,743 B2 3/2014 Flusche
8,720,128 B2 5/2014 Vogt
8,813,436 B2 8/2014 Donnally et al.
8,863,449 B2 10/2014 Donnally et al.
8,904,716 B2 12/2014 Donnally et al.
8,936,424 B1 1/2015 Barnes et al.
8,985,238 B2 3/2015 Sorokan et al.
8,985,928 B2 3/2015 Flusche
8,997,435 B2 4/2015 Reddy et al.
9,016,004 B2 4/2015 Vogt
9,027,287 B2 * 5/2015 Trevithick ..... E21B 15/00 52/112
9,091,125 B2 7/2015 Konduc et al.
9,091,128 B1 7/2015 Orgeron et al.
9,132,871 B2 9/2015 Crisp et al.
9,140,080 B2 9/2015 Flusche
9,151,412 B2 10/2015 Trevithick et al.
9,157,286 B2 10/2015 Richardson et al.
9,163,462 B2 10/2015 Donnally et al.
9,212,481 B2 12/2015 Stramandinoli
9,228,394 B2 1/2016 Wijning et al.
9,249,626 B2 2/2016 Flusche
9,260,929 B2 2/2016 Mark
9,267,328 B2 2/2016 Flusche
9,309,728 B2 4/2016 Reddy et al.
9,291,012 B2 5/2016 Wells, Sr.
9,353,601 B2 5/2016 Hause
9,382,766 B2 7/2016 Flusche
9,399,890 B2 7/2016 Mark
9,441,423 B2 9/2016 Donnally et al.
9,366,053 B2 10/2016 Thiessen et al.
9,464,488 B2 10/2016 Thiessen
9,476,267 B2 10/2016 Orgeron et al.
9,488,014 B2 * 11/2016 Sparkman ..... E21B 15/00
9,562,407 B2 2/2017 Magnuson
9,650,840 B2 5/2017 Cheng et al.
9,677,298 B2 * 6/2017 Konduc ..... E21B 7/02
9,708,861 B2 * 7/2017 Reddy ..... E21B 15/003
9,739,098 B2 8/2017 Fox
9,790,751 B2 10/2017 Reddy et al.
9,797,196 B2 10/2017 Taggart et al.
9,810,027 B2 11/2017 Reddy et al.
9,845,813 B2 12/2017 Shimizu et al.
9,879,442 B2 1/2018 Magnuson et al.
10,273,708 B2 4/2019 Holst et al.

(56) References Cited

U.S. PATENT DOCUMENTS

2002/0001255 A1 1/2002 Flood et al.
2003/0172599 A1 9/2003 Frink
2004/0211598 A1 10/2004 Palidis
2005/0193645 A1* 9/2005 Barnes ..... E21B 7/02 52/120
2006/0213653 A1* 9/2006 Cunningham ..... E21B 7/024 166/77.1
2008/0237170 A1 10/2008 Altman et al.
2009/0000218 A1 1/2009 Lee et al.
2009/0025980 A1 1/2009 Callander et al.
2009/0053013 A1 2/2009 Maltby
2009/0200856 A1 8/2009 Chehade et al.
2009/0272540 A1 11/2009 Rodgers
2010/0186960 A1 7/2010 Reitsma et al.
2010/0329823 A1 12/2010 Baumler et al.
2011/0072737 A1 3/2011 Wasterval
2011/0174545 A1 7/2011 Hartke et al.
2012/0168179 A1 7/2012 Having et al.
2012/0304553 A1 12/2012 Konduc et al.
2013/0269268 A1 10/2013 Thiessen et al.
2013/0305632 A1 11/2013 Rivera, Sr. et al.
2013/0330151 A1* 12/2013 Orgeron ..... E21B 19/087 414/22.71
2014/0014417 A1 1/2014 Smith et al.
2014/0054097 A1 2/2014 Bryant
2014/0090333 A1* 4/2014 Vogt ..... E21B 15/00 52/651.05
2014/0298735 A1* 10/2014 Vogt ..... E21B 7/023 52/118
2015/0008038 A1 1/2015 Folk
2015/0143759 A1* 5/2015 Sparkman ..... E21B 15/00 52/123.1
2015/0218891 A1* 8/2015 Padira ..... E21B 15/003 166/75.11
2015/0315861 A1 11/2015 Zachariasen et al.
2016/0002947 A1 1/2016 Wijning et al.
2016/0130877 A1 5/2016 Fortson et al.
2016/0186495 A1 6/2016 Flusche
2016/0215592 A1 7/2016 Helms et al.
2016/0258215 A1* 9/2016 Holst ..... E21B 15/00
2016/0258225 A1 9/2016 Holst et al.
2016/0280524 A1 9/2016 Crisp et al.
2016/0298394 A1 10/2016 Padira et al.
2016/0369570 A1 12/2016 Reddy et al.
2016/0376808 A1* 12/2016 Magnuson ..... E21B 19/12 52/123.1
2017/0096832 A1* 4/2017 Robb ..... E04H 12/345
2017/0106925 A1 4/2017 Gupta et al.
2017/0292334 A1 10/2017 Reddy et al.
2017/0328081 A1 11/2017 Trevithick et al.
2017/0350153 A1 12/2017 Reddy et al.
2018/0016851 A1 1/2018 Reddy et al.
2018/0030788 A1 2/2018 Reddy et al.
2018/0119496 A1 5/2018 Reddy et al.

FOREIGN PATENT DOCUMENTS

CN 201778661 U 3/2011
DE 849533 C 9/1952
EP 2751370 B1 7/2014
FR 2556042 A1 6/1985
WO 2016025521 A2 2/2016
WO 2016048458 A1 3/2016

OTHER PUBLICATIONS

Nabors 990 Proyecto Llanos.WMV; https://www.youtube.com/watch?v=6BgfgWumRIU, Nabors Rig 990 Chichimene, Colombia; Youtube.com; Aug. 10, 2011 (231 pages).
Drilling Contractor; "Nabors modular Rig 702 in Papua New Guinea—bound for ExxonMobil"; Drilling Contractor, in Drilling Rigs & Automation, News, Jul. 6, 2011; 2 pages; www.drillingcontractor.org.
Drilling Contractor; "Nabors to base all future land rigs on Minimum Area AC rig concept"; Drilling Contractor, in News, Aug. 22, 2011; 2 pages; www.drillingcontractor.org.
Sebastion, Simone; "Big drill soon begins long commute to work"; Houston Chronicle, Sunday, Jul. 3, 2011; 3 pages; www.chron.com.
Gaddy, Dean E., "Critical path analysis improves rig-moving procedures", Oil & Gas Journal, Nov. 16, 1998 (5 pages).

* cited by examiner

SIDE-SADDLE CANTILEVER MAST

CROSS REFERENCE TO RELATED APPLICATIONS

This application is a U.S. non-provisional application which claims priority from U.S. provisional application No. 62/418,656, filed Nov. 7, 2016, which is incorporated by reference herein in its entirety.

TECHNICAL FIELD

Field of the Disclosure

The present disclosure relates generally to drilling rigs, and specifically to rig structures for land drilling in the petroleum exploration and production industry.

Background of the Disclosure

Land-based drilling rigs may be configured to be traveled from location to location to drill multiple wells within the same area known as a wellsite. In certain situations, it is necessary to travel across an already drilled well for which there is a well-head in place. Further, mast placement on land-drilling rigs may have an effect on drilling activity. For example, depending on mast placement on the drilling rig, an existing well-head may interfere with the location of land-situated equipment such as, for instance, existing well-heads, and may also interfere with raising and lowering of equipment needed for operations. Traditional drilling rig mast designs typically include vertically erected bootstrap masts or cantilever masts transported with the "C" frame facing up or down.

SUMMARY

The present disclosure provides for a side saddle slingshot drilling rig. The side saddle slingshot drilling rig includes a right substructure and a left substructure, the substructures positioned generally parallel and spaced apart from each other. The right substructure includes a right lower box and a first strut, the first strut pivotably coupled to the drill rig floor and pivotably coupled to the right lower box. The left substructure includes a left lower box and a second strut, the second strut pivotably coupled to the drill rig floor and pivotably coupled to the left lower box. The side saddle slingshot drilling rig also includes a drill rig floor, the drill rig floor including a V-door. The side of the drill rig floor has the V-door defining the V-door side of the drill rig floor, the V-door side of the drill rig floor parallel to the right substructure. The side saddle slingshot drilling rig further includes a mast, the mast including an open side defining a mast V-door side. The open side is oriented to face perpendicular to the right substructure. The mast is pivotably coupled to the drill rig floor by one or more mast pivot points and one or more lower mast attachment points, the mast being pivotable in a direction parallel to the V-door side of the drill rig floor or the mast being pivotable in a direction perpendicular to V-door side of the drill rig floor. The mast includes two or more subunits, wherein the two or more subunits are pinned together.

The present disclosure also includes a method of transporting a mast. The method of transporting a mast includes transporting a lower mast subunit, the lower mast subunit including a lower mast section. A top drive is positioned within the lower mast section. The lower mast section has a V-door side. The lower mast-subunit is transported such that the V-door side of the lower mast section is perpendicular to the ground. The method of transporting a mast also includes transporting a middle mast subunit. The middle mast subunit includes a middle mast section, the middle mast section having a V-door side. The middle mast subunit is transported such that the V-door side of the middle mast section is perpendicular to the ground. The method of transporting a mast also includes transporting an upper mast subunit, the upper mast subunit including an upper mast section. A travelling block is positioned within the upper mast section. The upper mast section has a V-door side. The upper mast subunit is transported such that the V-door side of the upper mast section is perpendicular to the ground.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
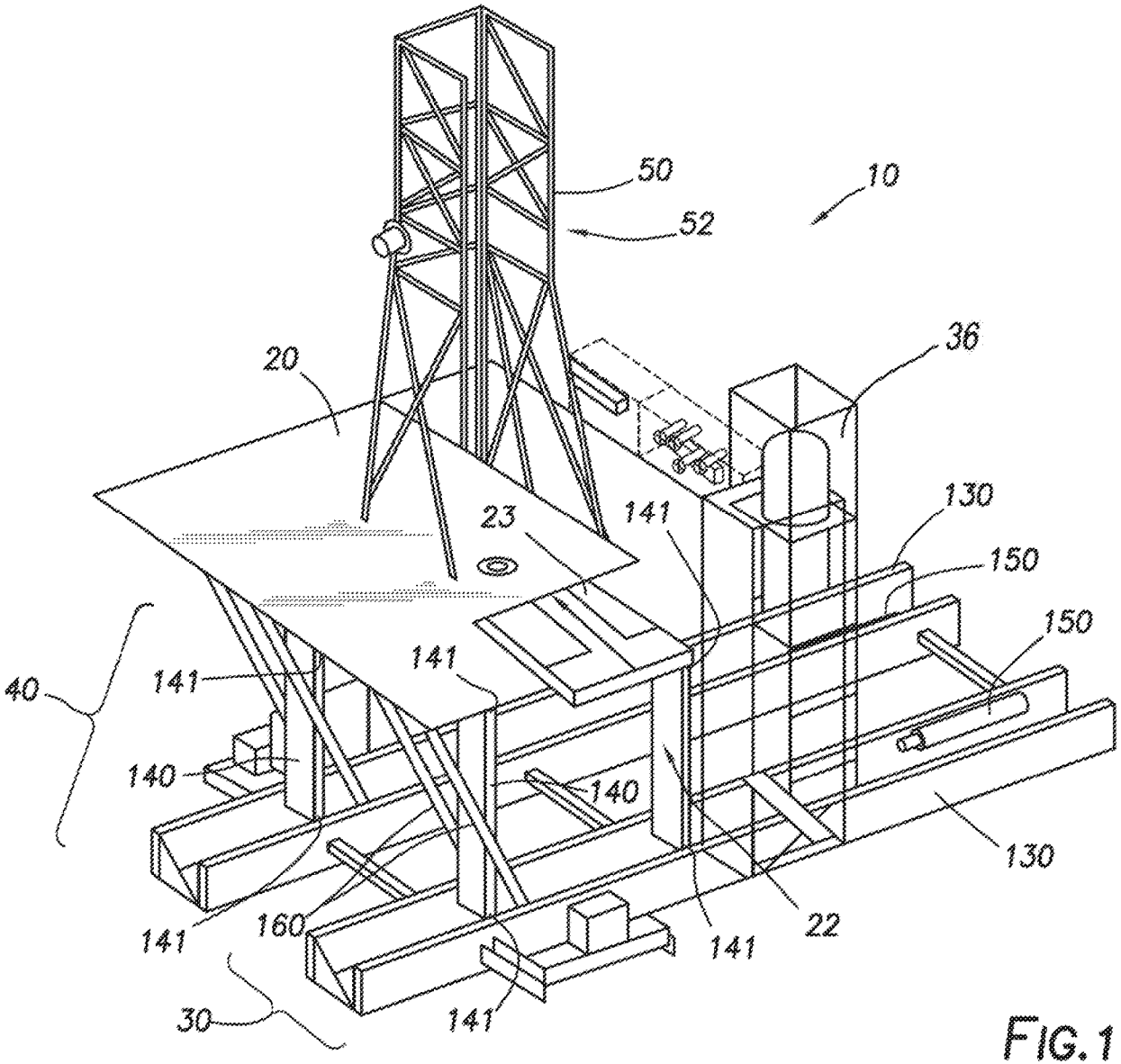
FIG. 1 depicts a perspective view of a side saddle slingshot drilling rig consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts a perspective view of side saddle slingshot drilling rig 10 in a mast raised position. In some embodiments, side saddle slingshot drilling rig 10 may include drill rig floor 20, right substructure 30, left substructure 40, and mast 50. Right and left substructures 30, 40 may support drill rig floor 20. Right and left substructures 30, 40 may be generally parallel and spaced apart in the right-left direction. As would be understood by one having ordinary skill in the art with the benefit of this disclosure, the terms "right" and "left" as used herein are only used to refer to each separate substructure to simplify discussion, and are not intended to limit this disclosure in any way. Right and left substructures 30, 40, may each include one or more lower boxes 130 and one or more struts 140. Drill rig floor 20 may be mechanically coupled to lower boxes 130 by struts 140. Struts 140 may be pivotably coupled to drill rig floor 20 and to one or more lower boxes 130, where struts 140 are pivotably coupled to drill rig floor 20 at pivot points 141. Lower boxes 130 may be generally parallel to each other and spaced apart in the left-right direction. In some embodiments, struts 140 may be coupled to drill rig floor 20 and lower boxes 130 such that struts 140 form a bar linkage between lower boxes 130 and drill rig floor 20, allowing relative motion of drill rig floor 20 relative to lower boxes 130 while maintaining drill rig floor 20 parallel to lower boxes 130 as further discussed herein below. In some embodiments, right substructure 30 may include a lower box 130 referred to herein as a right lower box. In some embodiments, left substructure 40 may include a lower box 130 referred to herein as a left lower box. Although shown in FIG. 1 as having a long side and a short side, lower boxes 130 may be of any shape including a square.

In some embodiments, drill rig floor 20 may include V-door 23. The side of drill rig floor 20 at which V-door 23 is referred to herein as V-door side 22. In some embodiments, V-door side 22 of side saddle slingshot drilling rig 10 may face the right substructure 30. In some embodiments, V-door 23 may be oriented to face perpendicular to right substructure 30. In some embodiments, V-door side 22 may be parallel to right substructure 30.

Figure 2:
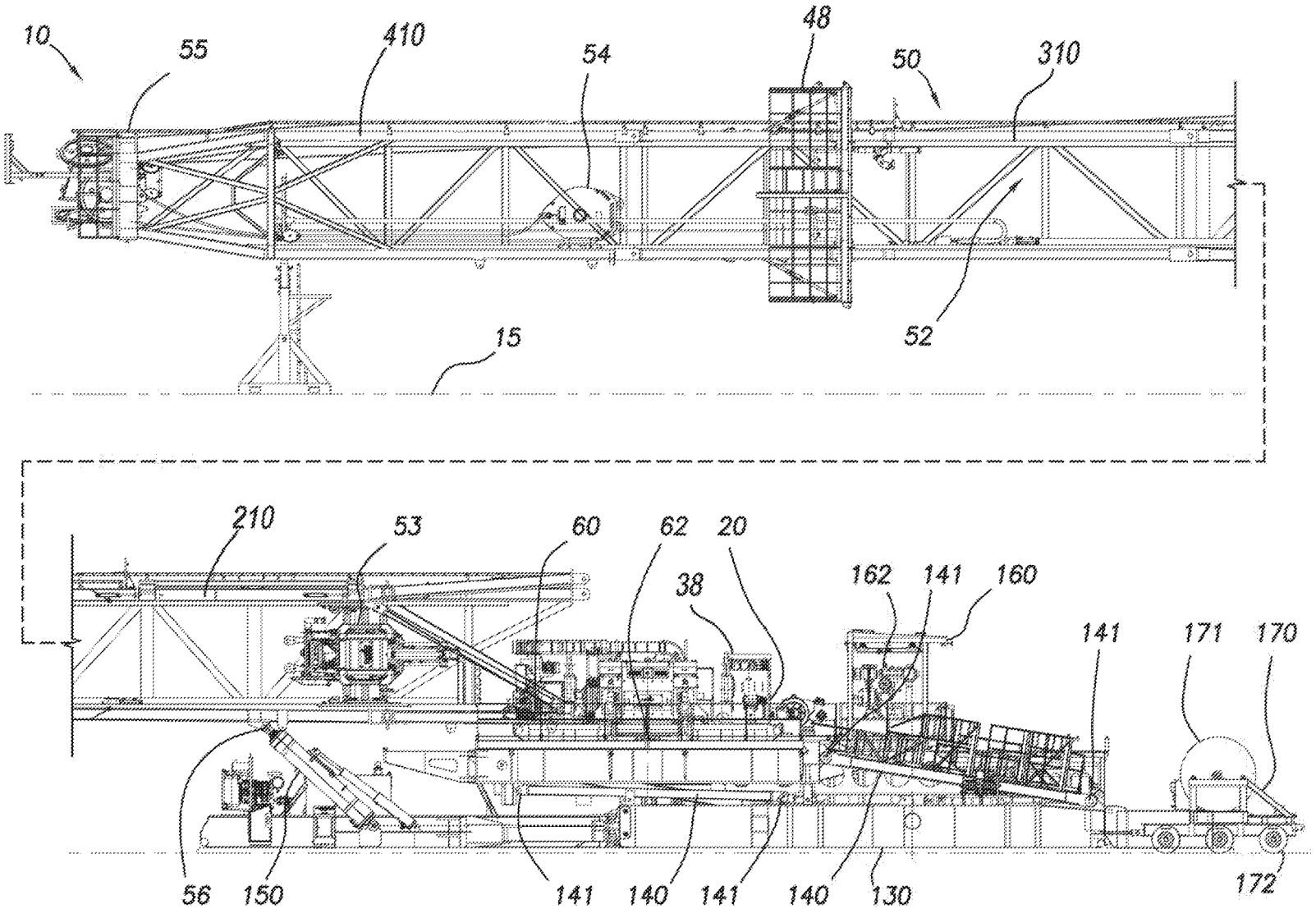
FIG. 2 depicts a side saddle slingshot drilling rig with the mast and drill rig floor in lowered positions consistent with at least one embodiment of the present disclosure.

In some embodiments, mast 50 may include mast V-door side 52, defined as the open side of mast 50. In some embodiments, mast V-door side 52 may be aligned with V-door 23. In some embodiments, mast V-door side 52 may be oriented to face perpendicular to right substructure 30. FIG. 2 depicts side saddle slingshot drilling rig 10 consistent with at least one embodiment of the present disclosure. As shown in FIG. 2, in some embodiments, mast 50 may be pivotably coupled to drill rig floor 20 by one or more mast pivot points 60 and one or more lower mast attachment points 62. Lower mast attachment points 62 may be disconnected, allowing mast 50 to pivot on mast pivot points 60 as further discussed herein below. In some such embodiments, mast 50 may thus be lowerable from the upright position depicted in FIG. 1 to the lowered position shown in FIG. 2. FIG. 2 further depicts drawworks 38, wherein drawworks 38 is mechanically coupled to left substructure 40. In other embodiments, drawworks 38 is mechanically coupled to right substructure 30. In addition, FIG. 2 depicts racking board 48 attached to mast 50.

Figure 3:
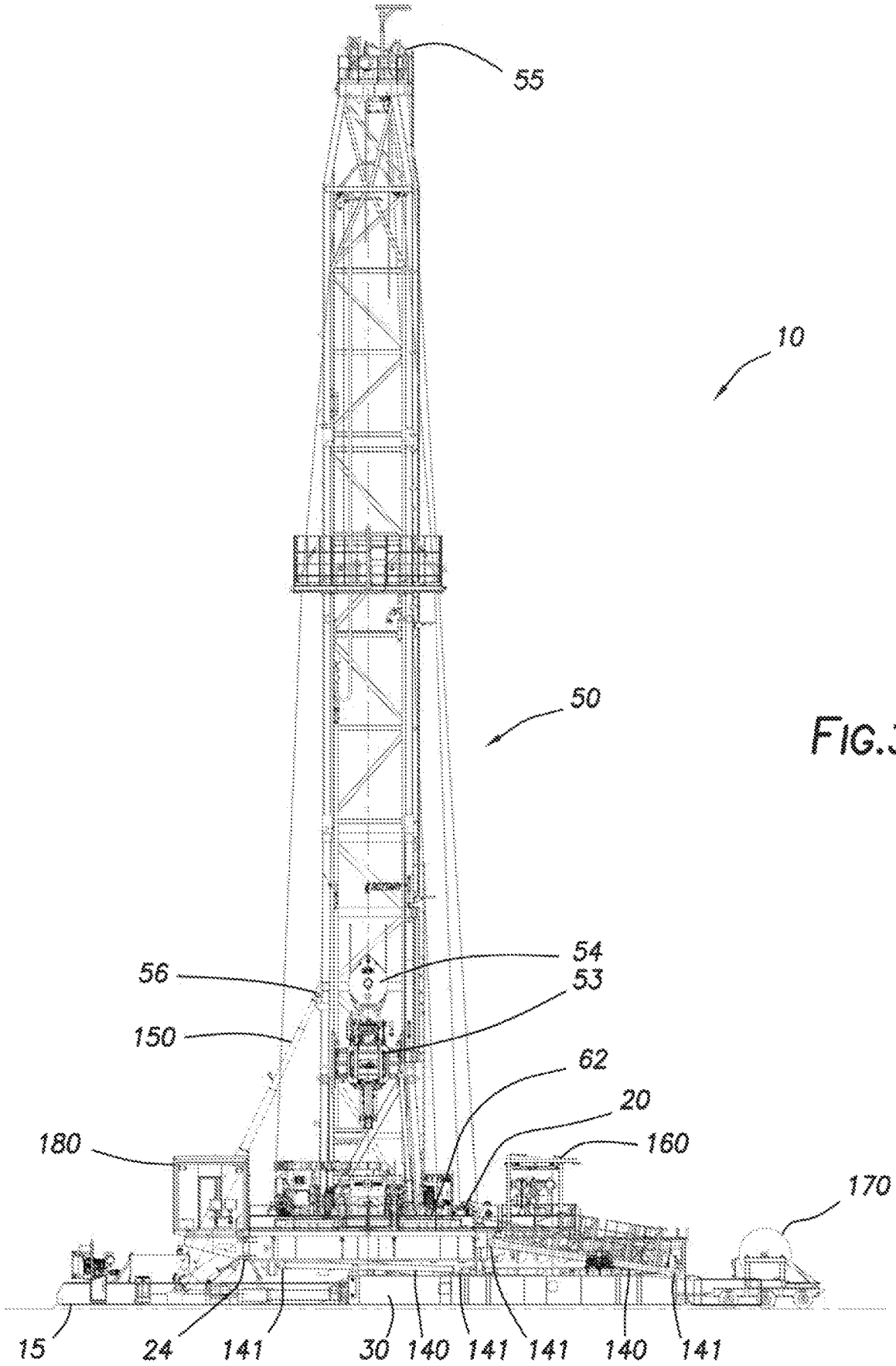
FIG. 3 depicts a side saddle slingshot drilling rig with the mast in a raised position and the drill rig floor in the lowered position consistent with at least one embodiment of the present disclosure.
Figure 4:
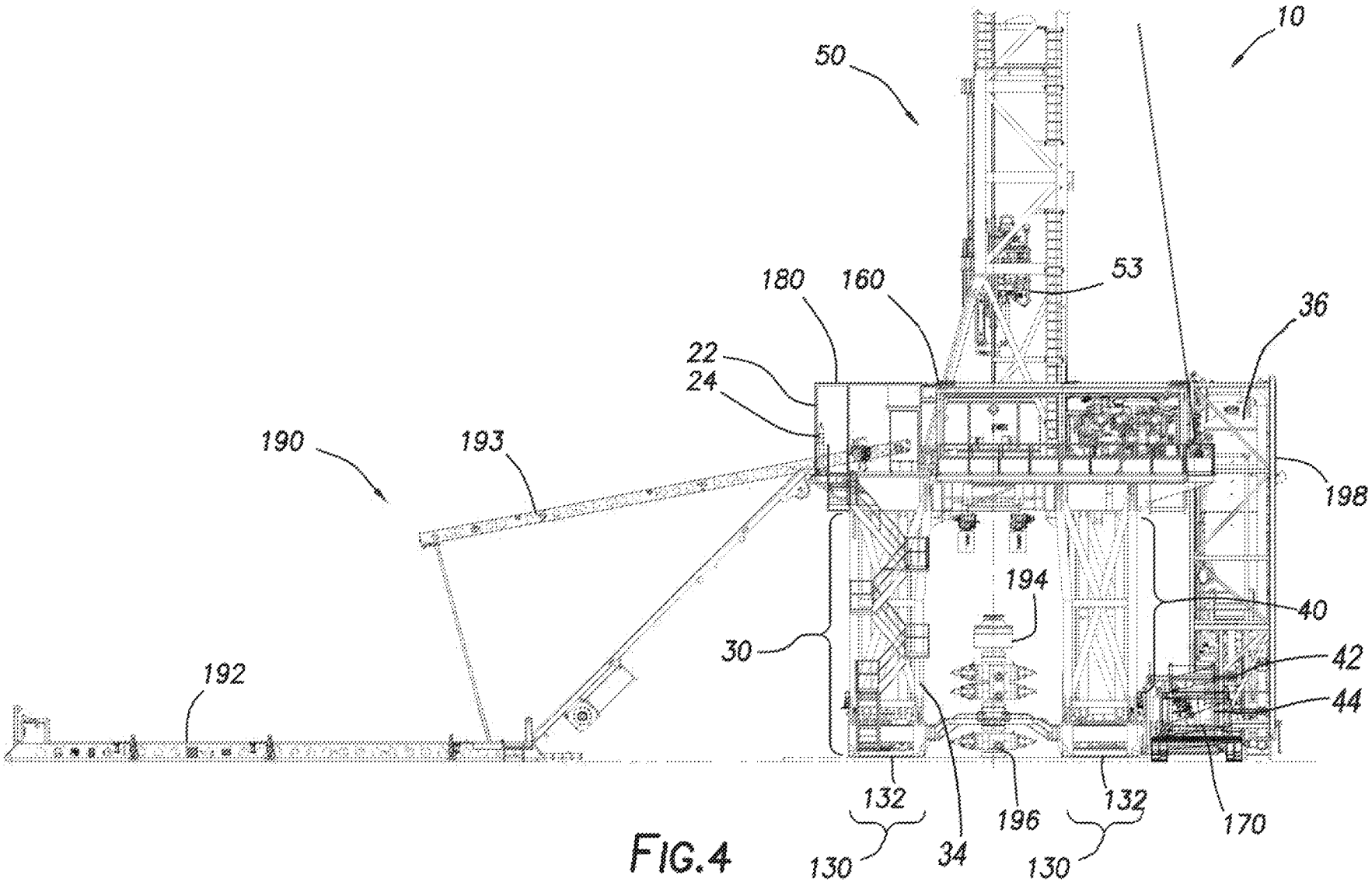
FIG. 4 depicts a side saddle slingshot drilling rig with the mast in a raised position and the drill rig floor in the raised position consistent with at least one embodiment of the present disclosure.
Figure 5:
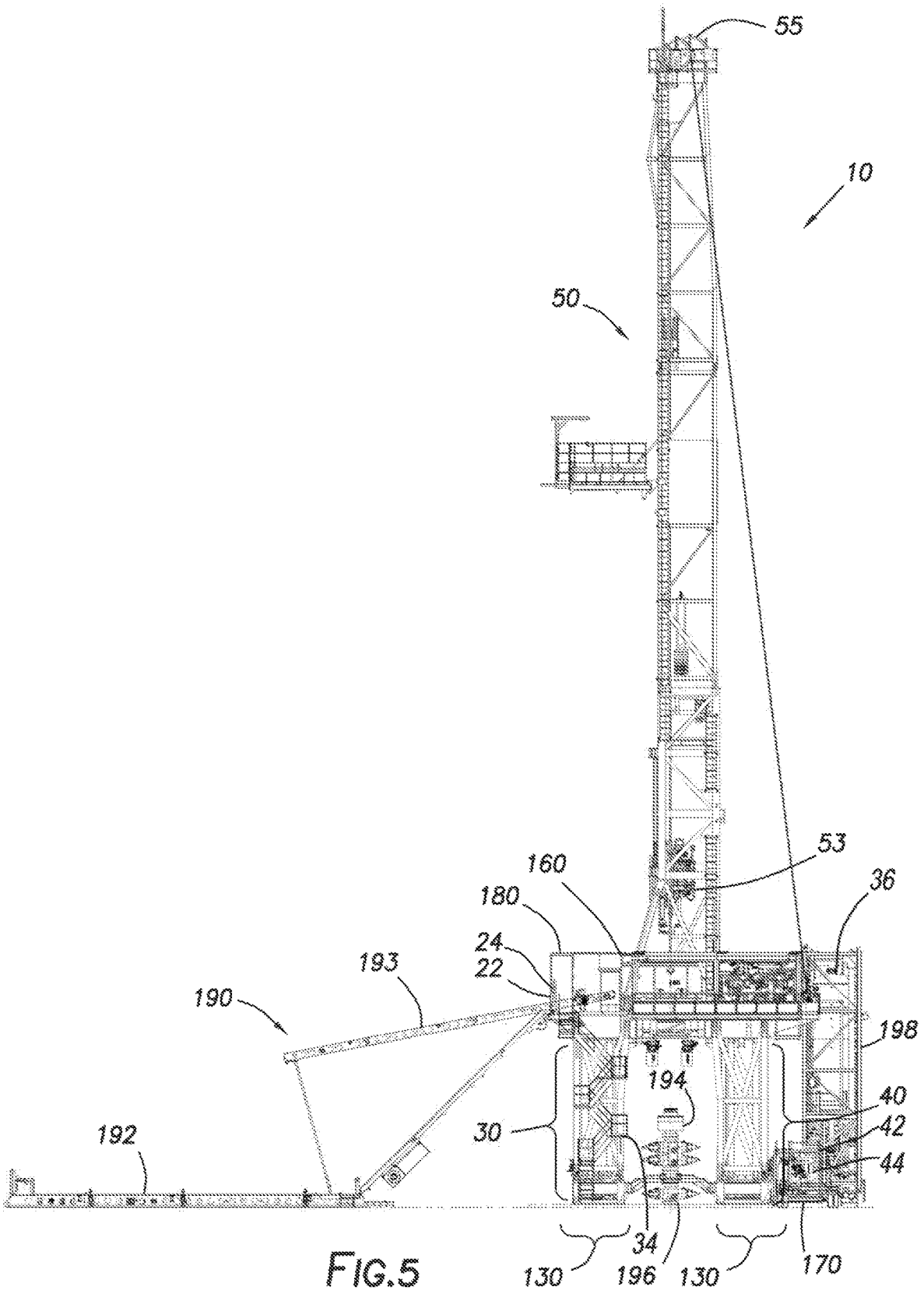
FIG. 5 depicts a side saddle slingshot drilling rig with the mast in a raised position and the drill rig floor in the raised position consistent with at least one embodiment of the present disclosure.

In some embodiments, to move mast 50 from the lowered position to the mast raised position, mast 50 may be transported to side saddle slingshot drilling rig 10 and may be mechanically coupled to drill rig floor 20 by pivot points 60 using, for example and without limitation, one or more pins. One or more hydraulic cylinders 150 may be mechanically coupled to mast 50. In some embodiments, hydraulic cylinders 150 may mechanically couple to one or more corresponding upper mast attachment points 56 positioned on mast 50. In some embodiments, mast 50 may be moved into the mast raised position by extending hydraulic cylinders 150 such that mast 50 moves from a horizontal position as depicted in FIG. 2 to a vertical position as depicted in FIG. 3. Mast 50 may be mechanically coupled to drill rig floor 20 by lower mast attachment points 62 using, for example and without limitation, one or more pins to support and retain mast 50 in the vertical position. In some embodiments, hydraulic cylinders 150 may be detached from upper mast attachment points 56 once mast 50 is secured to drill rig floor 20 by lower mast attachment points 62. In some embodiments, hydraulic cylinders 150 may be mechanically coupled to drill rig floor lifting points 24. Hydraulic cylinders 150 may then be extended to move drill rig floor 20 from the lowered position as depicted in FIG. 3 to the raised position as depicted in FIGS. 1, 4. Hydraulic cylinders 150 may then be disconnected from drill rig floor lifting points 24, retracted and stored in right and left substructures 30, 40. In some embodiments, hydraulic cylinders 150 may be utilized to transition side saddle slingshot drilling rig 10 from the raised position to the mast raised position and the lowered position by reversing the previously described operations. FIGS. 3, 4, and 5 further depict drillers cabin 180 mechanically coupled to right substructure 30. In other embodiments, drillers cabin 180 may be mechanically coupled to left substructure 40 or drill rig floor 20. In certain embodiments, drillers cabin 180 may house a control center, such as an MCC, and a variable frequency drive (VFD).

As further shown in FIG. 2, in some embodiments, mast 50 is pivotably lowerable in a direction parallel to V-door side 22 of drill rig floor 20. In such an embodiment, mast V-door side 52 may be oriented to face horizontally, i.e., mast V-door side 52 may be may be perpendicular to ground 15, when mast 50 is in the lowered position. In an alternative embodiment, mast 50 is pivotable in a direction away from the V-door side 22 when lowered. In yet another embodiment, mast 50 is pivotable in a direction toward the V-door side 22 when lowered.

In some embodiments, components of mast 50 including, for example and without limitation, top drive 53, traveling block 54, and crown assembly 55 may be retained within mast 50 when mast 50 is in the lowered position without additional components. In some embodiments, mast 50 may be removeable from drill rig floor 20 and transported horizontally. In some such embodiments, top drive 53, traveling block 54, and crown assembly 55 may be retained within mast 50 when mast 50 is transported.

FIG. 2 further depicts choke house 160 mechanically coupled to right substructure 30. In other embodiments, choke house 160 may be mechanically coupled to left substructure 40 or positioned on drill floor 20. Choke house 160 houses choke manifold 162 which includes set of high pressure valves and at least two chokes. Positioned adjacent to and attached to lower box 130 is drill line spooler 170. As further described below, drill line spooler 170 may include spool 171 positioned on spool bogie 172.

FIGS. 4 and 5 depict side saddle slingshot drilling rig 10 with mast 50 and drill rig floor 20 in raised positions. FIGS. 4 and 5 further depict catwalk assembly 190 mechanically connected to V-door side 22 of drill rig floor 20. Catwalk assembly 190 may include catwalk 192 and slide 193. Also shown in FIG. 4 is wellhead 196 including BOP 194. As shown in FIG. 4 lower boxes 130 may be positioned on to the right and left side of wellhead 196, with right substructure 30 and left substructure 40 of sufficient height to allow drill rig floor 20 to clear BOP 194. Walkers 132 may be positioned within lower boxes 130. FIGS. 4 and 5 further depict mud gas separator 198. Mud gas separator 198 may be connected to drill rig floor 20, such as by hanging mud gas separator 198 from drill rig floor 20. In other embodiments, mud gas separator 198 may be connected to left substructure 40. In yet other embodiments, mud gas separator 198 may be connected to right substructure 30. In certain embodiments, mud gas separator 198 may be positioned opposite V-door 23 on side saddle slingshot drilling rig 10.

FIGS. 4 and 5 further depict stair tower 34 mechanically coupled to right substructure 30. In other embodiments, stair tower 34 may be mechanically coupled to left substructure 40. FIGS. 4 and 5 also depict standpipe manifold 36 mechanically connected to left substructure 40. In other embodiments, such as that shown in FIG. 1, standpipe manifold 36 is mechanically connected to right substructure 30. FIGS. 4 and 5 also depict hydraulic power unit 42 mechanically connected to left substructure 40. In other embodiments, hydraulic power unit 42 is mechanically connected to right substructure 30. In addition, FIGS. 4 and 5 depict accumulator 44 mechanically connected to left substructure 40. In other embodiments, accumulator 44 is mechanically connected to right sub structure 30.

Figure 6:
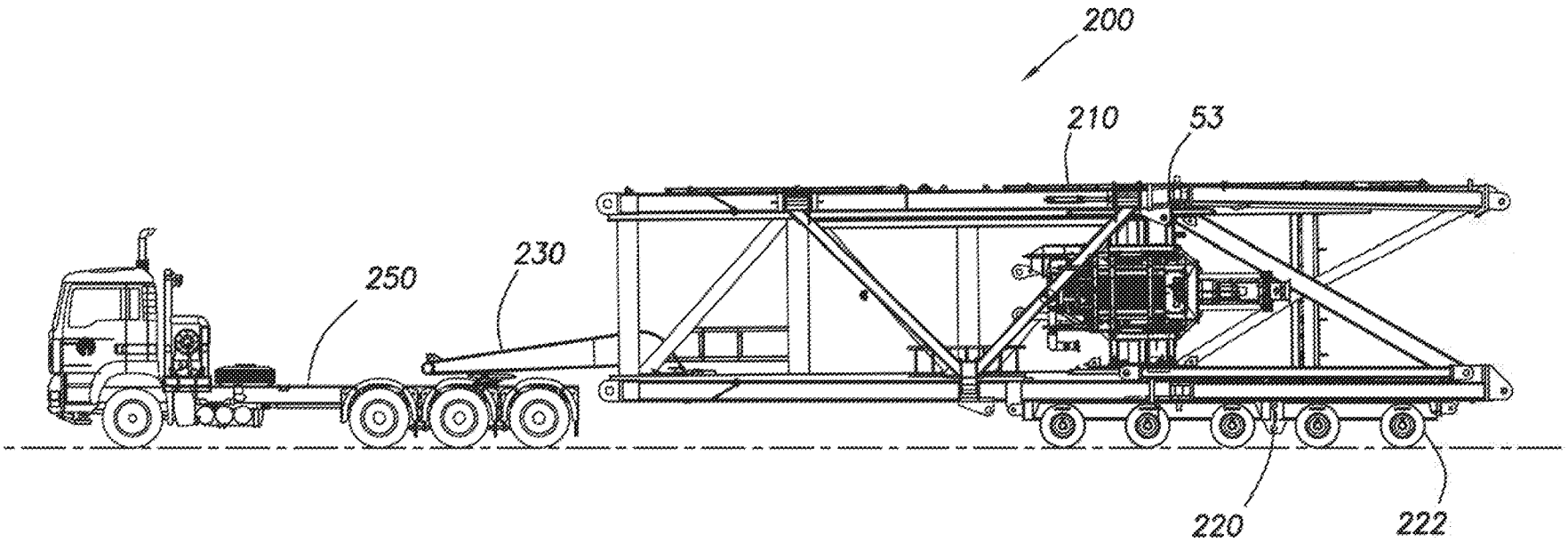
FIG. 6 is a side view of lower mast subunit consistent with at least one embodiment of the present disclosure.
Figure 7:
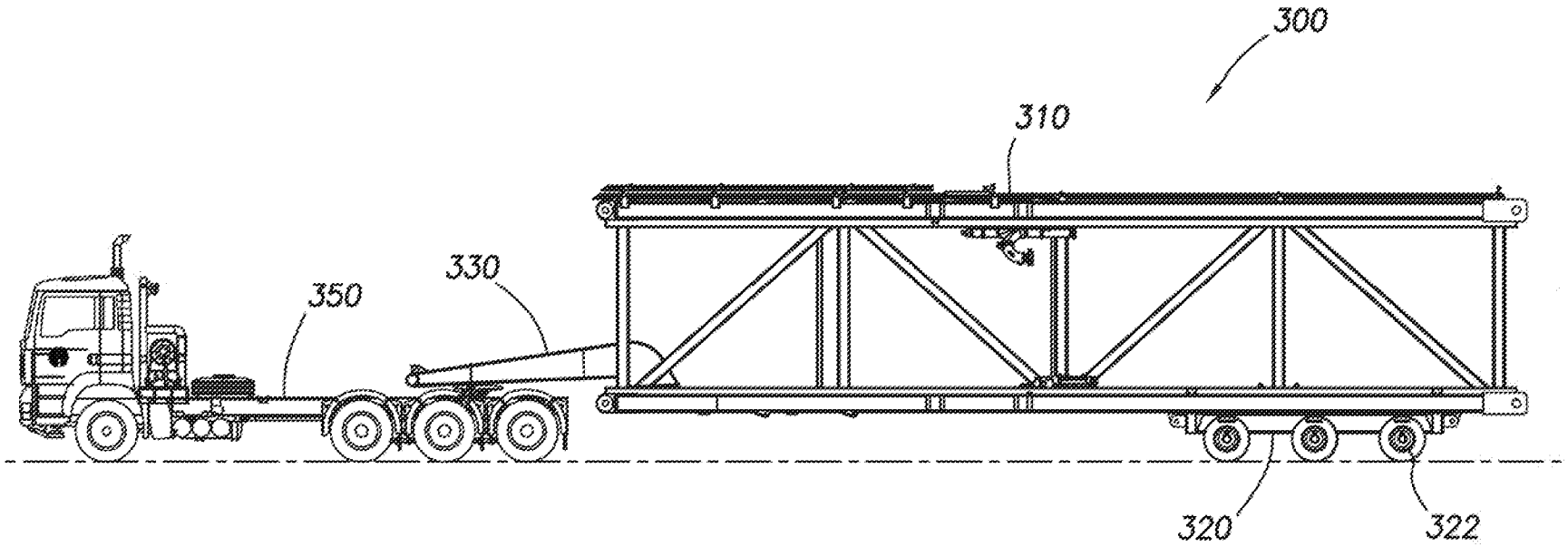
FIG. 7 is a side view of middle mast subunit consistent with at least one embodiment of the present disclosure.
Figure 8:
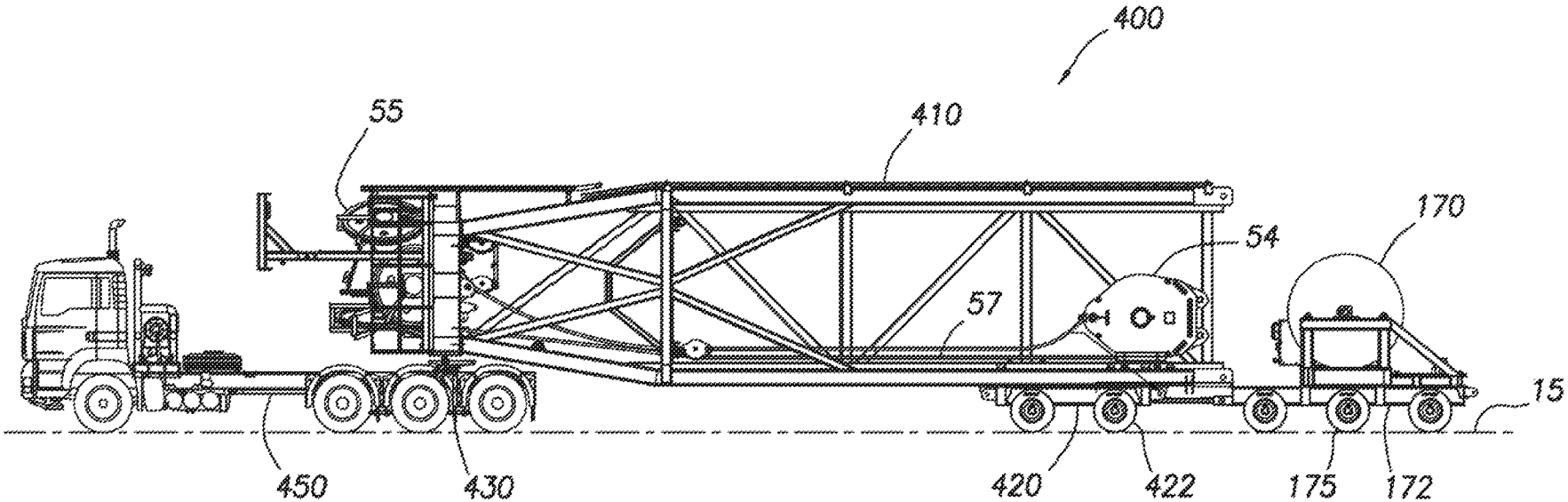
FIG. 8 is a side view of upper mast subunit consistent with at least one embodiment of the present disclosure.

In certain embodiments, mast 50 may be composed of two or more subunits, wherein the subunits may be independently transportable. FIGS. 6, 7, and 8 depict lower mast subunit 200, middle mast subunit 300, and upper mast subunit 400, respectively. As shown in FIG. 6, lower mast subunit 200 includes lower mast section 210. In some embodiments, top drive 53 may be positioned within lower mast subunit 200 during transportation of lower mast subunit 200. During transport, lower mast subunit 200 may also include lower mast subunit bogie 220. Lower mast subunit bogie 220 is shown with five sets of wheels 222, although this number of sets of wheels 222 is non-limiting. Lower mast subunit bogie 220 may be mechanically connected to lower mast section 210 during transport and may be removeable thereafter. In certain embodiments, as further shown in FIG. 6, lower mast subunit gooseneck 230 may be mechanically connected to lower mast section 210 during transport and removeable thereafter. In an alternative embodiment, lower mast subunit gooseneck 230 is not removed. Lower mast subunit gooseneck 230 may be adapted to mechanically connect with tractor 250 for transport.

Figure 6A:
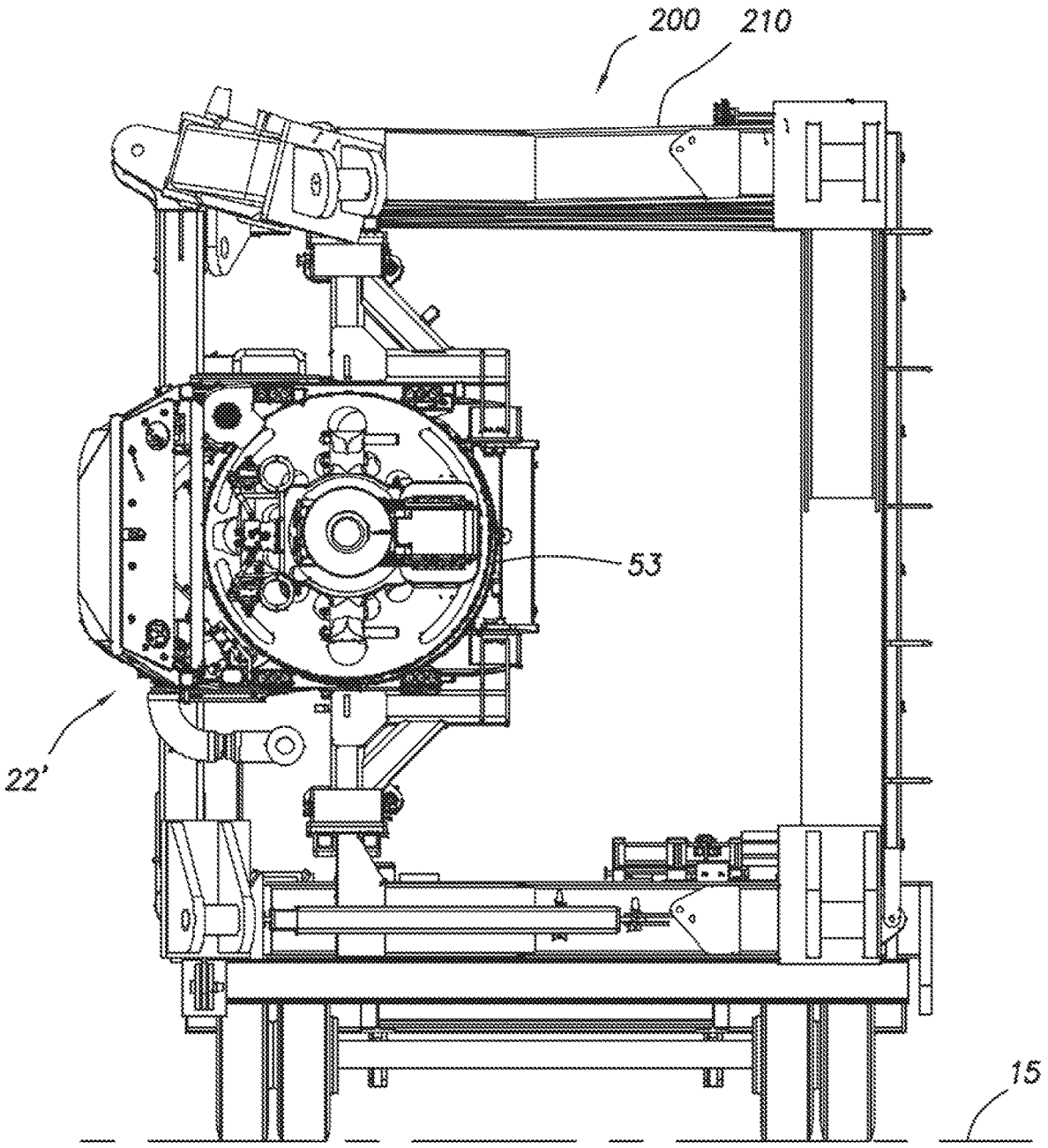
FIG. 6A is an end view of lower mast subunit consistent with at least one embodiment of the present disclosure.

FIG. 6A is an end view of lower mast subunit 200. As shown in FIG. 6A, V-door side 22' of lower mast section 210 is perpendicular to ground 15, i.e., V-door side 22' of lower mast section 210 is vertical during transport. FIG. 6A also depicts one non-limiting position of top drive 53 within lower mast section 210.

Figure 7A:
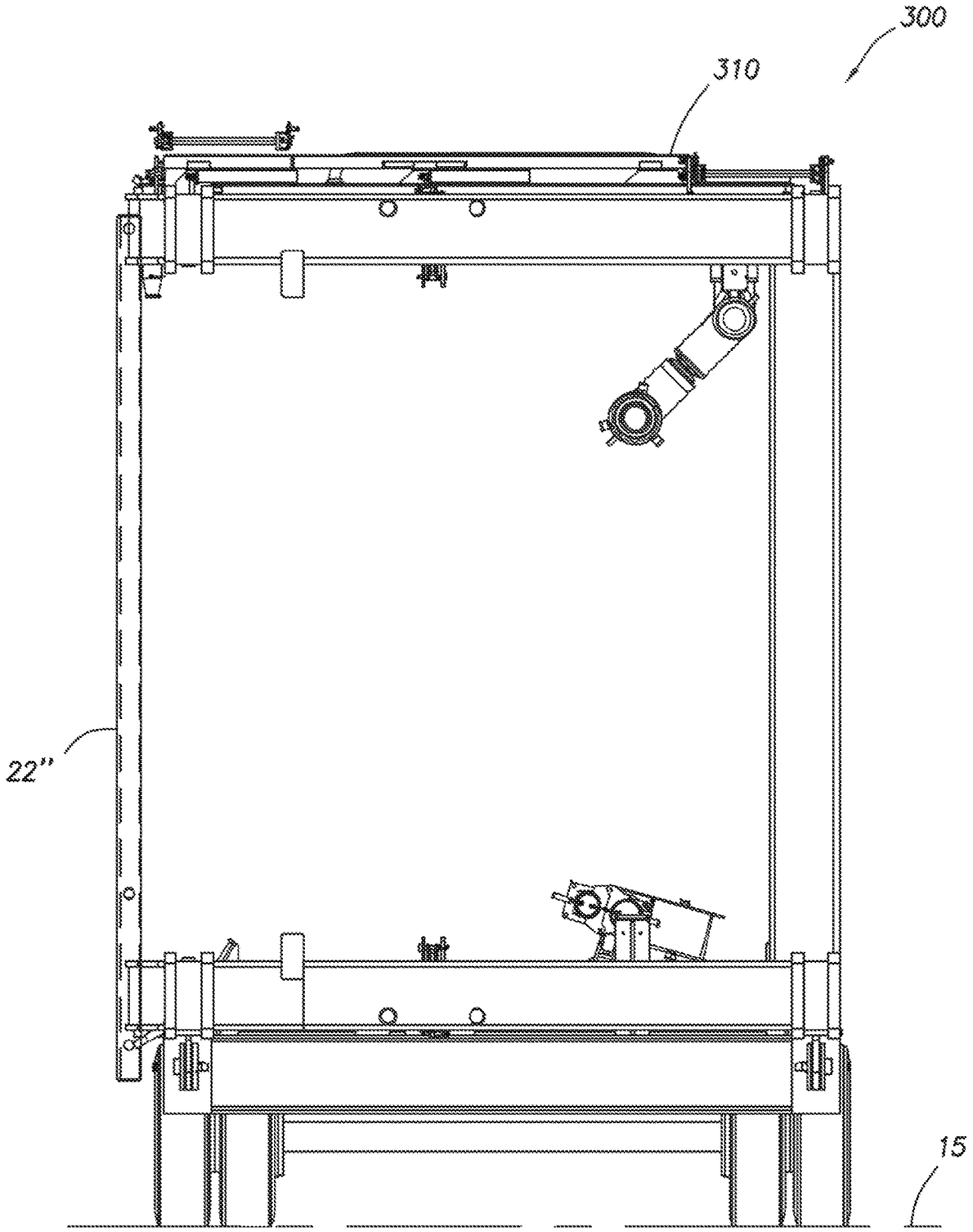
FIG. 7A is an end view of middle mast subunit consistent with at least one embodiment of the present disclosure.

FIG. 7 depicts middle mast subunit 300, which includes middle mast section 310. During transport, middle mast subunit 300 unit may also include middle mast subunit bogie 320. Middle mast subunit bogie 320 is shown with three sets of wheels 322, although this number of sets of wheels 322 is non-limiting. Middle mast subunit bogie 320 may be mechanically connected to middle mast section 310 during transport and may be removeable thereafter. In certain embodiments, as further shown in FIG. 7, middle mast subunit gooseneck 330 may be mechanically connected to middle mast section 310 during transport and removeable thereafter. In an alternative embodiment, middle mast subunit gooseneck 330 is not removed. Middle mast subunit gooseneck 330 may be adapted to mechanically connect with tractor 350 for transport. FIG. 7A is an end view of middle mast subunit 300. As shown in FIG. 7A, V-door side 22" of middle mast section 310 is perpendicular to ground 15, i.e., V-door side 22" of middle mast section 310 is vertical during transport. In certain embodiments, middle mast section 310 may be transported with racking board 48 in a folded configuration.

FIG. 8 depicts upper mast subunit 400, which includes upper mast section 410. During transport, upper mast subunit 400 may also include upper mast subunit bogie 420. Upper mast subunit bogie 420 is shown with two sets of wheels 422, although this number of sets of wheels 422 is non-limiting. Upper mast subunit bogie 420 may be mechanically connected to upper mast section 410 during transport and may be removeable thereafter. In certain embodiments, as further shown in FIG. 8, upper mast subunit kingpin 430 may be mechanically connected to upper mast section 410. Upper mast subunit kingpin 430 may be adapted to mechanically connect with tractor 450 for transport. In certain embodiments, as shown in FIG. 8, crown assembly 55 may be positioned atop upper mast section 410 and connected by drill line 57 to travelling block 54. Travelling block 54 may be transported within upper mast section 410. In some embodiments, upper mast subunit 400 may be mechanically connected to drill line spooler 170 during transport. Drill line spooler 170 may be mounted on spool bogie 172 such that upper mast subunit 400 and drill line spooler 170 are transported together by tractor 450. In some embodiments, drill line 57 may remain operationally coupled to drill line spooler 170 and the sheaves of crown assembly 55 and travelling block 54 during transport. By transporting drill line spooler 170 with upper mast subunit 400 and by keeping drill line 57 operationally coupled to crown assembly 55 and travelling block 54, the time required to rig-up or rig-down mast 50 may be reduced compared to a mast 50 that transports these components separately or without drill line 57 operatively connected thereto. Although spool bogie 172 is shown with three wheels 175, this number of wheels 175 is non-limiting and any number of wheels 175 may be used.

Figure 8A:
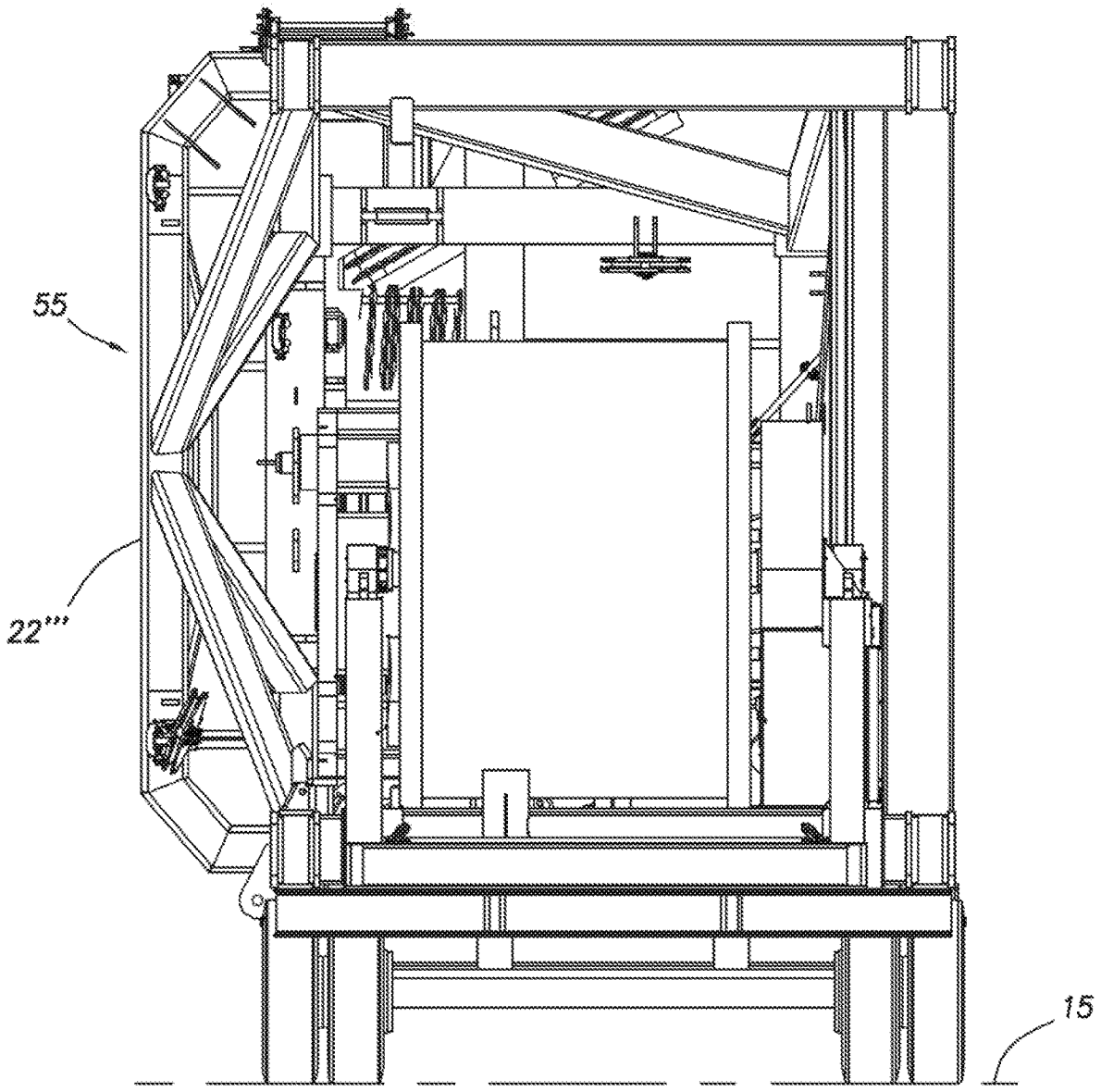
FIG. 8A is an end view of upper mast subunit consistent with at least one embodiment of the present disclosure.

FIG. 8A is an end view of upper mast subunit 400. As shown in FIG. 8A, V-door side 22'" of upper mast section 410 is perpendicular to ground 15, i.e., V-door side 22'" of upper mast section 410 is vertical during transport.

In some embodiments, in order to assemble mast 50, lower mast subunit 200, middle mast subunit 300, and upper mast subunit 400 may be transported to side saddle slingshot drilling rig 10. Lower mast subunit 200, middle mast subunit 300, and upper mast subunit 400 may be positioned horizontally in alignment with each other and may be joined to form mast 50. In some embodiments, lower mast subunit 200, middle mast subunit 300, and upper mast subunit 400 may be joined by, for example and without limitation, one or more pinned connections. Mast 50 may then be coupled to mast pivot points 60 and raised as discussed herein above. Drill line 57 may be operatively coupled to a hoisting device such as a drawworks, and travelling block 54 may be lowered therewith and coupled to top drive 53.

In some embodiments, mast 50 may be lowered and disassembled to, for example and without limitation, transport mast 50. In such an operation, top drive 53 may be lowered using travelling block 54 such that top drive 53 is positioned within lower mast subunit 200. Top drive 53 may then be secured to lower mast subunit 200. Travelling block 54 may then be raised until travelling block 54 is positioned within upper mast subunit 400. Mast 50 may then be lowered as discussed herein above, decoupled from mast pivot points 60, and separated into lower mast subunit 200, middle mast subunit 300, and upper mast subunit 400. In some embodiments, bogeys 220, 320, and 420 may be coupled to the respective mast subunits 200, 300, and 400, and mast subunits 200, 300, and 400 may be transported separately as discussed herein above. In some embodiments, drill line spooler 170 may be coupled to upper mast subunit 400 such that drill line spooler 170 is transported with upper mast subunit 400.

Figure 9:
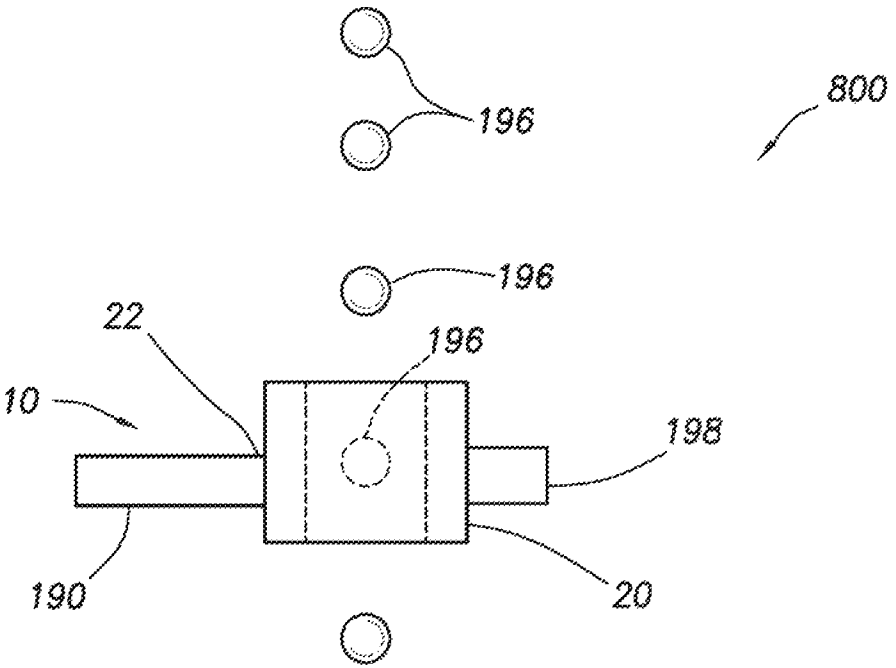
FIG. 9 is a schematic depiction of a filed having well-heads.

FIG. 9 depicts field 800 having a plurality of wellheads 196 arranged in a row. As shown in FIG. 9, V-door side 22 is positioned parallel to the row of wellheads 196. Unlike conventional rigs, side saddle slingshot drilling rig 10 may skid or walk over a row of wellheads 196 without rig up and rig down time. By positioning the V-door side perpendicular to right substructure 30 or left substructure 40, catwalk assembly 190 is positioned away from an adjacent wellhead instead of across or on top of an adjacent wellhead. In certain embodiments, as lower mast subunit 200, middle mast subunit 300, and upper mast subunit 400 are transported horizontally, the mast may be raised without requiring breakdown of catwalk assembly 190.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A side saddle slingshot drilling rig comprising:

a right substructure and a left substructure, the substructures positioned generally parallel and spaced apart from each other;

the right substructure comprises a right lower box and a first strut, the first strut pivotably coupled to the drill rig floor and pivotably coupled to the right lower box;

the left substructure comprises a left lower box and a second strut, the second strut pivotably coupled to the drill rig floor and pivotably coupled to the left lower box;

a drill rig floor, the drill rig floor including a V-door, the side of the drill rig floor including the V-door defining the V-door side of the drill rig floor, the V-door side of the drill rig floor parallel to the right substructure; and a mast, the mast including an open side defining a mast V-door side, the open side oriented to face perpendicular to the right substructure, the mast pivotably coupled to the drill rig floor by one or more mast pivot points and one or more lower mast attachment points, the mast being pivotable in a direction parallel to the V-door side of the drill rig floor or the mast being pivotable in a direction perpendicular to V-door side of the drill rig floor, the mast comprised of two or more subunits including:

an upper mast subunit, the upper mast subunit including an upper mast section, a travelling block positioned within the upper mast section, the upper mast section having a V-door side, the upper mast subunit adapted to be transported such that the V-door side of the upper mast section is perpendicular to the ground; and a lower mast subunit, the lower mast subunit including a lower mast section, a top drive positioned within the lower mast section, the lower mast section having a V-door side, the lower mast-subunit adapted to be transported such that the V-door side of the lower mast section is perpendicular to the ground.

2. The side saddle slingshot drilling rig of claim 1, wherein the two or more subunits comprise a lower mast subunit, a middle mast subunit, and an upper mast subunit.

3. The side saddle slingshot drilling rig of claim 1 further comprising a catwalk assembly, the catwalk assembly including a catwalk and a slide, the catwalk mechanically connected to V-door side of the drill rig floor.

4. The side saddle slingshot drilling rig of claim 3, wherein the struts form a bar linkage between the lower boxes and the drill rig floor.

5. The side saddle slingshot drilling rig of claim 4, wherein the struts are adapted to allow motion of the drill rig floor relative to the lower boxes while maintaining the drill rig floor parallel to the lower boxes.

6. The side saddle slingshot drilling rig of claim 3, wherein the V-door side of the drill rig floor is parallel to the right substructure.

7. The side saddle slingshot drilling rig of claim 3, wherein the right and left lower boxes further comprise one or more hydraulic cylinders, the hydraulic cylinders mechanically coupled to one or more corresponding upper mast attachment points of the mast.

8. The side saddle slingshot drilling rig of claim 7, wherein the mast includes one or more braces positioned to brace the mast at the mast attachment points of the mast.

9. The side saddle slingshot drilling rig of claim 8, wherein the mast is pivotable in a direction away from the V-door side of the drill rig floor when lowered.

10. The side saddle slingshot drilling rig of claim 8, wherein the mast is pivotable in a direction toward the V-door side of the drill rig floor when lowered.

11. The side saddle slingshot drilling rig of claim 1 further comprising a choke house positioned on the drill rig floor or mechanically coupled to the right or left substructure.

12. The side saddle slingshot drilling rig of claim 11, wherein the choke house includes a choke manifold.

13. The side saddle slingshot drilling rig of claim 1 further comprising drill line spooler, the drilling rig spooler attached to lower box, the drill line spooler including a spool positioned on a spool bogie.

14. The side saddle slingshot drilling rig of claim 1 further comprising walkers, the walkers positioned within the lower boxes.

15. The side saddle slingshot drilling rig of claim 1 further comprising a mud gas separator, the mud gas separator mechanically coupled to the right or left substructure.

16. The side saddle slingshot drilling rig of claim 1 further comprising a stair tower, the stair tower mechanically coupled to the right substructure or left substructure.

17. The side saddle slingshot drilling rig of claim 1 further comprising a standpipe manifold, the standpipe manifold mechanically connected to the right substructure of left sub structure.

18. The side saddle slingshot drilling rig of claim 1 further comprising a drawworks, the drawworks mechanically connected to the left substructure or right substructure.

19. The side saddle slingshot drilling rig of claim 1 further comprising a hydraulic power unit, the hydraulic power unit mechanically connected to the left substructure or right sub structure.

20. The side saddle slingshot drilling rig of claim 1 further comprising an accumulator, the accumulator mechanically connected to the left substructure or right sub structure.

21. The side saddle slingshot drilling rig of claim 1 further comprising a drillers cabin, the drillers cabin mechanically connected to the left or right substructure.

* * * * *